US006742602B2

(12) United States Patent
Trotechaud

(10) Patent No.: US 6,742,602 B2
(45) Date of Patent: Jun. 1, 2004

(54) PERFORATING GUN FIRING HEAD WITH VENTED BLOCK FOR HOLDING DETONATOR

(75) Inventor: Kevin Trotechaud, Sherwood Park (CA)

(73) Assignee: Computalog Limited, Calgary (CA)

( * ) Notice: Subject to any disclaimer, the term of this patent is extended or adjusted under 35 U.S.C. 154(b) by 0 days.

(21) Appl. No.: 10/228,892

(22) Filed: Aug. 27, 2002

(65) Prior Publication Data

US 2003/0041723 A1 Mar. 6, 2003

Related U.S. Application Data

(60) Provisional application No. 60/315,633, filed on Aug. 29, 2001.

(51) Int. Cl.[7] ..... E21B 43/116
(52) U.S. Cl. ..... 175/4.54; 89/1.15
(58) Field of Search ..... 125/4.54; 89/1.15

(56) References Cited

U.S. PATENT DOCUMENTS 5,088,413 A 2/1992 Huber et al.

2002/0125045 A1 * 9/2002 George ..... 175/4.54

OTHER PUBLICATIONS

Scalloped Gun System, Owen Oil Tools, 2000, 1 page.

Resistorized Bridge Detonators, Owen Oil Tools, 2000, 1 page.

Petroleum Well Construction, Michael J. Economides, Larry T. Watters, Shari Dunn–Norman, John Wiley & Sons, Ltd., 1998, west Sussex, England, Chapter 13, Perforating by James Barker and Phil Sinder, pps. 345–369.

* cited by examiner

*Primary Examiner*—William Neuder
(74) *Attorney, Agent, or Firm*—Geoffrey A. Mantooth

(57) ABSTRACT

A firing head for a perforating gun includes a detonating block having a first end and a second end, with the second end being structured and arranged so as to be located adjacent to a detonation material. A central passage extends through the detonating block from the first end to the second end. A detonator is located and restrained in the passage so as to be adjacent to the detonating material. At least one venting passage extends from the central passage to an exterior of the detonating block.

2 Claims, 4 Drawing Sheets

PERFORATING GUN FIRING HEAD WITH VENTED BLOCK FOR HOLDING DETONATOR

This application claims the benefit of U.S. patent application Ser. No. 60/315,633, filed Aug. 29, 2001.

FIELD OF THE INVENTION

The present invention relates to apparatuses for perforating wells, such as oil and gas wells, and in particular to firing heads of perforating guns.

BACKGROUND OF THE INVENTION

Perforating guns have an array of explosive charges thereon. The explosive charges can fire projectiles or form a jet of liner material (such as copper). The guns are lowered inside of a cased well to a depth containing a pay zone of oil or gas. The explosive charges are detonated wherein the casing is perforated at the pay zone. Upon the completion of the well, oil and gas can then flow through the perforations into the casing and up to the surface.

Great care is taken with the explosive charges in the perforating guns in order to prevent their accidental detonation. An accidental detonation with the gun on the surface could result in the injury of a crew member. An accidental detonation in the well in an undesirable location could result in a loss of production of the well. Therefore, initiators are used to better control the detonation of the perforating guns. One type of initiator is known as a detonator, which is an electrical device.

Detonators are initiated by an electrical current. An electrical current heats a resistive element inside the detonator to a temperature that is sufficiently high to ignite a charge inside of the detonator. The detonator is located physically close to an end of a detonating cord so as to ignite the detonating cord. When ignited, the detonating cord propagates the detonation from the detonator to fire the explosive charges that are distributed along the length of the perforating gun.

One type of detonator has a spring loaded pin or button on one end and an explosive charge on the other end. For safety reasons, the detonator is internally grounded until the button is depressed. Thus, when internally grounded, the detonator is in a safe mode and is unable to detonate. This type of detonator is conventional and commercially available as part number DET-3050-008 from Owen Oil Tools of Fort Worth, Tex.

The detonator is located in a detonating block, which is located in a firing head at an end of the perforating gun. The detonator is contained within the detonating block and is adjacent to an end of the detonating cord in the perforating gun. A long rod, or arming and contact pin, is used to press the button on the detonator in order to arm it. Thus, the detonating block secures the detonator in place adjacent to the detonating cord and positions the detonator relative to the arming and contact rod.

Conventional detonating blocks function as collars to hold the detonator in place. Consequently, conventional detonating blocks have a passage extending from one end of the block to the other. Upon detonation, some of the hot gases from the detonator and the detonating cord blow back in the direction of the arming and contact pin, damaging the pin and its associated spring in the process.

When the perforating gun is brought back out of the hole to the surface after a detonation, such damage must be fixed before the gun can be reused. Often times, a well requires multiple perforations, requiring the perforating gun to make more than one trip downhole. Minimizing the damage to the detonating mechanism minimizes turnaround time for the perforating gun on the surface and equipment loss.

SUMMARY OF THE INVENTION

It is an object of the present invention to provide a firing head for a perforating gun that has minimum damage during a detonation.

It is another object of the present invention to provide a firing head for a perforating gun that can be reused with a minimum amount of turnaround time and equipment.

The present invention provides a firing head for a perforating gun for use in downhole applications. The firing head comprises a detonating block and a detonator. The detonating block has a first end and a second end, with the second end being structured and arranged so as to be located adjacent to a detonating material. A central passage extends through the detonating block from the first end to the second end. The central passage is structured and arranged to receive a detonator. At least one venting passage extends from the central passage through the detonating block to an exterior of the detonating block.

In accordance with one aspect of the present invention, the central passage further comprises a collar for receiving a detonator, the collar having an inside diameter that is smaller than an inside diameter of a portion of the central passage that is located between the collar and the second end.

In accordance with another aspect of the present invention, there is at least one venting passage between the collar and the first end of the detonating block and at least one venting passage between the collar and the second end of the detonating block.

In accordance with another aspect of the present invention, the venting passage between the collar and the second end of the detonating block is larger than the venting passage between the collar and the first end of the detonating block.

In accordance with still another aspect of the present invention, the firing head further comprises a detonator located and restrained in the central passage.

The present invention also provides a firing head for a perforating gun for use in downhole applications comprising a sub having a first end and a second end. A pin is located in the sub and is axially movable therein. The pin has a head located adjacent to the second end of the sub. A detonating block is removably coupled to the second end of the sub. The detonating block has a first chamber that receives the head of the pin and a detonating chamber that is structured and arranged to be adjacent to a detonating material in the perforating gun. The detonating block has a retainer located between the chamber and the detonating chamber. A detonator is located in the retainer and extends into the detonating chamber. The detonator has an arming mechanism that is located in the first chamber in selective contact with the head of the arming and contact pin. There is at least one venting passage in the detonating block extending from the detonating chamber to an exterior of the detonating block.

In accordance with another aspect of the present invention, the firing head further comprises at least one venting passage in the detonating block extending from the first chamber to the exterior of the detonating block.

The present invention also provides a method of detonating explosive charges in a downhole perforating gun. An arming mechanism for a detonator is provided. The detonator is provided in proximity to a detonating material. The arming mechanism, the detonator and the detonating material are all located along a longitudinal axis. The detonator is detonated. Gases from the detonator are vented laterally of the longitudinal axis so as to minimize damage to the arming mechanism.

In accordance with one aspect of the present invention, the step of providing the detonator in proximity to a detonating material further comprises the step of providing the detonator in a holder. The step of venting gases from the detonator laterally further comprises the step of venting the gases through the holder.

DESCRIPTION OF THE PREFERRED EMBODIMENT

Figure 1:
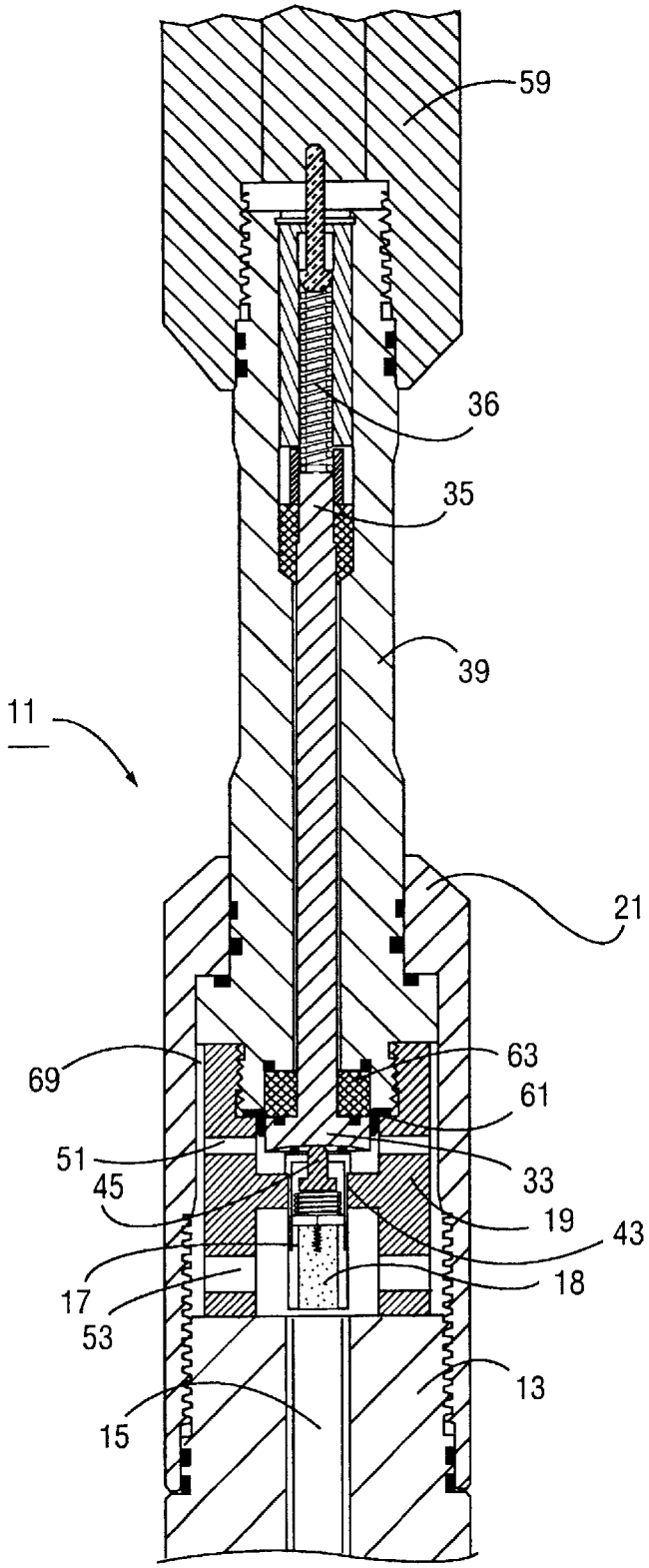
FIG. 1 is a longitudinal cross-sectional view of a firing head of a perforating gun of the present invention, in accordance with a preferred embodiment, shown with the detonator in the armed position.

FIG. 1 illustrates a firing head 11, or detonating arrangement, for a top-fire perforating gun 13. The perforating gun 13 is designed to be lowered into an oil or gas well inside of casing. The perforating gun 13 has a number of shaped charges (not shown) located below the firing head. Detonating cord 15 extends from the bottom of the firing head to each of the shaped charges.

The firing head 11 includes a detonator 17 aligned with the end of the detonating cord 15. The detonator 17 is maintained in alignment by a detonating block 19, which block is contained within a spinning collar 21.

Figure 2:
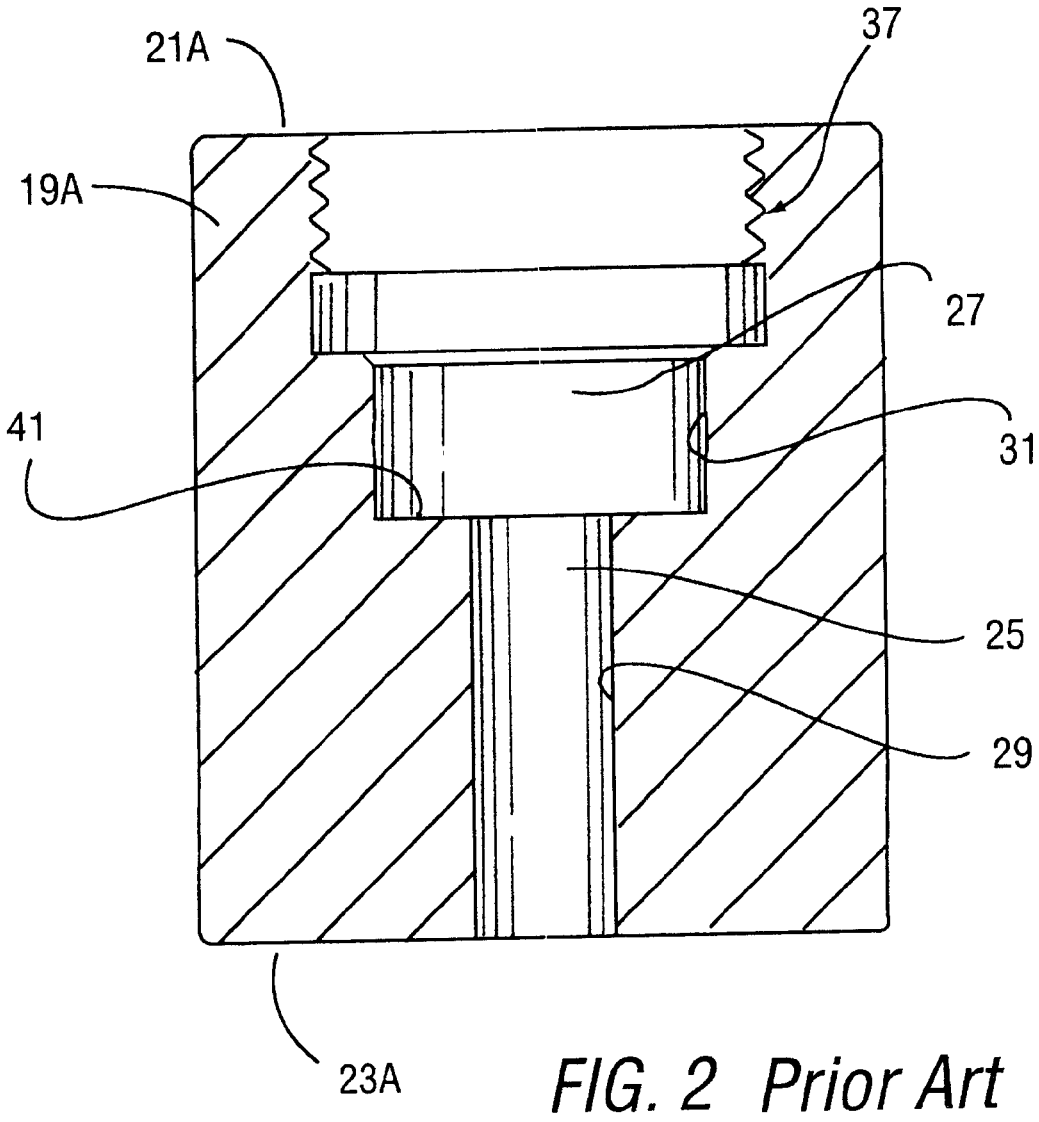
FIG. 2 Prior Art
FIG. 2 is a longitudinal cross-sectional view of a prior art detonating block.

FIG. 2 shows a prior art detonating block 19A. The detonating block 19A is cylindrical, having first and second ends 21A, 23A. A central, cylindrical passage 25 extends through the block 19A, from the first end 21A to the second end 23A. The passage 25 has a first portion 27 extending from the first end 21A to about midway of the block, and a second portion 29, extending from about midway to the second end 23A. The second portion 29 of the passage is narrow, having a diameter that is slightly larger than the detonator 17. The first portion 27 of the passage is of a larger diameter. The first portion 27 has a first bore 31 that is smooth walled and of a diameter that is sufficiently large to receive a head 33 of an arming and contact pin 35 (see FIG. 1). The first portion of the passage also has a threaded counterbore 37 coupled to an end of an arming and contact pin sub 39. A shoulder 41 is formed at the junction of the first and second portions of the passage. The shoulder 41 serves as a stop surface for the detonator 17.

The conventional and commercially available detonator 17 is cylindrical with a stop shoulder 43 (see FIG. 1). In the preferred embodiment, the detonator has a button 45 at one end. The button must be depressed to arm the detonator. Once armed, electrical current is sent through the button and out via the casing. The detonator has an explosive charge 18 therein.

The present invention improves the detonating block 19A by providing venting passages from the central passage containing the detonator to the outside of the detonating block. In addition, the portion of the central passage near the second end of the detonating block is enlarged. Furthermore, the outside diameter of the block is reduced.

Figure 3:
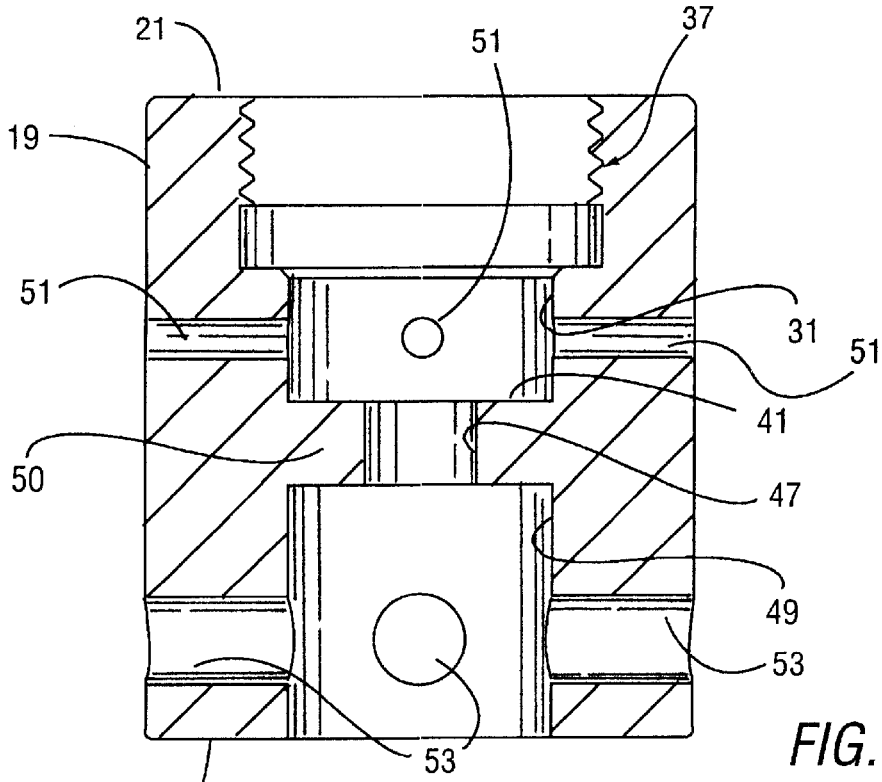
FIG. 3 is a longitudinal cross-sectional view of the detonating block of the present invention, in accordance with a preferred embodiment.
Figure 4:
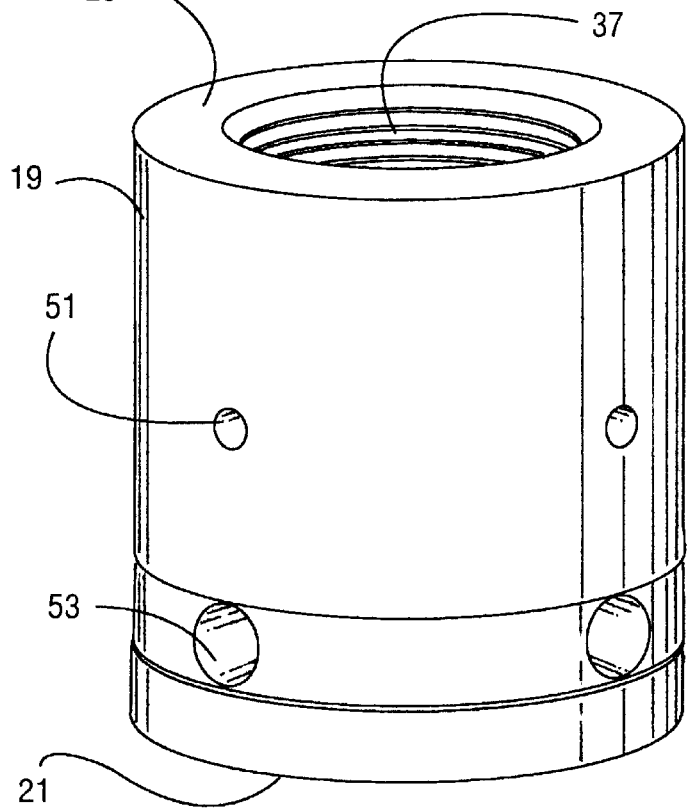
FIG. 4 is an isometric view of the detonating block of FIG. 3.

To describe the detonating block 19, terms such as "upper" and "lower" will be used with reference to the orientation of FIGS. 1, 3–6. Referring to FIG. 3, the detonating block 19 of the present invention has first and second ends 21, 23 (upper and lower ends), a smooth bore 31 and a threaded counterbore 37 adjacent to the upper end. There is also a shoulder 41 functioning as a stop surface for the detonator 17. A narrow central bore 47 or passage extends from the shoulder 41 towards the lower end 23. A counterbore 49 extends from the lower end to the narrow bore 41. The counterbore 49 is of a larger diameter than the central bore 47. The counterbore 49 forms a detonating chamber, while the bore 31 forms an upper chamber. Between the bores 31, 49, a collar or retainer 50 is formed, through which the central bore 47 extends. The collar 50 is about midway between the first and second ends 21, 23. The bore 47 has a diameter that is slightly larger than the diameter of the detonator 17.

The upper chamber 31 has a diameter that is sufficiently large to receive the head 33 of the arming and contact pin 35.

Venting passages 51, 53 extend radially outward from the upper and detonating chambers 31, 49 to the outside of the detonating block. There are upper venting passages 51 that vent the upper chamber 31 and lower venting passages 53 that vent the detonating chamber 49. The lower venting passages 53 are larger in diameter than the upper venting passages because most of the gases escape through the lower venting passages. Some gas does pass through the collar and out through the upper venting passages 51. In the preferred embodiment shown in FIGS. 3 and 4, there are four lower venting passages 53 spaced 90° apart around the circumference of the detonating block. Likewise, there are four upper venting passages 51 spaced 90° apart around the circumference of the detonating block.

The size and number of venting passages can vary. For example, the lower venting passages can be smaller in size while greater in number or larger in size while fewer in number. Also, the passages need not be circular bores as shown. Circular bores are easy to machine with the use of drill bits. However, the detonating block 19 can be cast, wherein the venting passages need not be circular. Also, as shown in FIG. 3, the venting passages are purely radial in direction having no axial or circumferential component. However, the venting passages can be inclined so as to have an axial and/or circumferential component.

The outside diameter of the detonating block 19 is smaller than the outside diameter of the lower end portion 40 of the sub 39, which lower end portion is received by the collar 21. This creates an annulus 69 around the detonating block 19.

Figure 5:
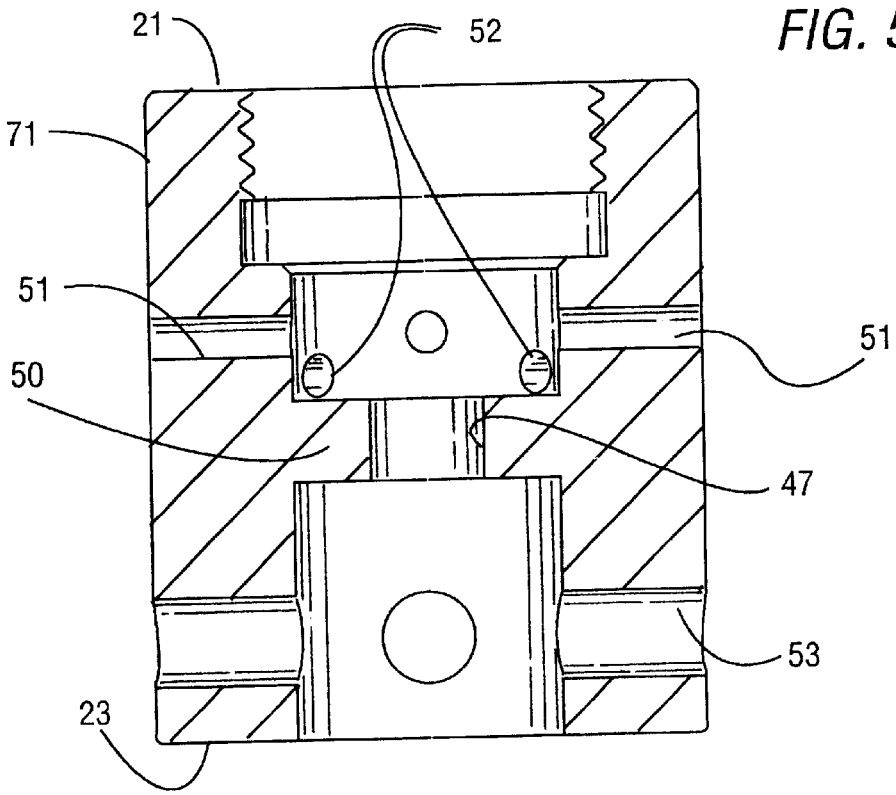
FIG. 5 is a longitudinal cross-sectional view of the detonating block, in accordance with another embodiment.
Figure 6:
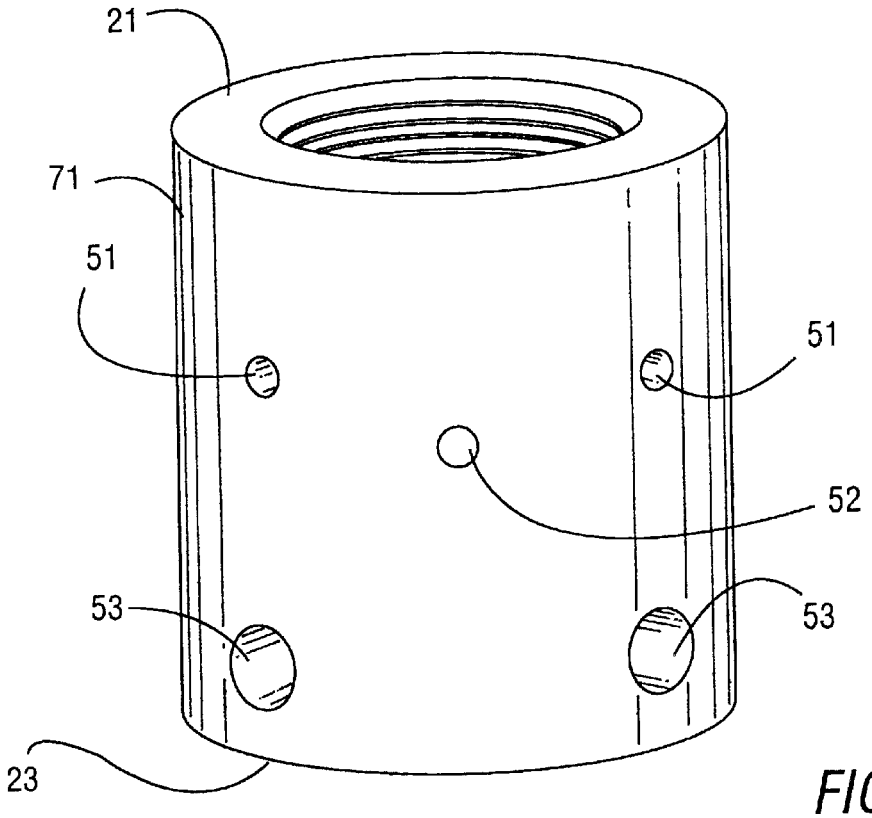
FIG. 6 is an isometric view of the detonating block of FIG. 5.

FIGS. 5 and 6 show the detonating block 71 in accordance with another embodiment. The block 71 is substantially similar to the block 19 of FIGS. 3 and 4 except that additional upper venting passages 52 are provided. Thus, the upper venting passages 51, 52 are spaced 45 degrees apart around the circumference of the block. In addition, the upper venting passages 52 are offset longitudinally from the upper venting passages 51. In the embodiment shown, the passages 52 are located closer to the collar 50.

The firing head 11 is assembled in accordance with normal procedures; the detonating block 19 of the present invention does not alter the assembly. The assembly will be briefly described with reference to FIG. 1. The detonator 17 is inserted into the opening 47 of the collar 50. The stop shoulder 43 of the detonator 17 bears on the shoulder 41 of the collar 50 and the button 45 on the detonator is nearest the upper end 21 of the detonating block. The detonating block is threaded onto the lower end of the arming and contact pin sub 39, such that the head 33 of the arming and contact pin 35 is located adjacent to the button 33. Once the detonating block 19 is threaded onto the sub 39, the button 45 is depressed, thereby arming the detonator 17 (not shown). A cap (not shown) may be used on the upper end of the sub 39 and a plug (not shown) may be used on the lower end of the spinning collar 31 during assembly as safety devices. A cable head 59 (shown schematically in FIG. 1) is screwed onto the upper end of the sub 39, followed by threading the spinning collar 21 onto the upper end of the perforating gun 13. The inside of the spinning collar is sealed so as to prevent fluid from reaching the fluid sensitive detonator 17.

In operation, the detonator 17 is unarmed as long as the button 45 is extended. The perforating gun is lowered downhole to its desired depth. When ready to perforate, an electrical current is passed through the pin in the detonator. The detonator detonates, igniting the detonating cord and explosive charges contained in the perforating gun.

The detonating detonator produces hot gases in the detonating chamber 49. Without the venting passages 51, 53 these gases create an overpressure along the longitudinal axis of the tool that bends and distorts the arming and contact pin 35. However, the venting passages 51, 53 allow the gases to escape transversely to the annulus 69 around the detonating block 19 and flow away from the pin 35. Some of the gases flow into the upper passage 31 and through the upper venting passages 31 to the annulus 69. Thus, the gases are unable to create an overpressure that is sufficient to damage the pin 35 and its spring 36.

To rearm the perforating gun, the gun is retrieved to the surface. The firing head 11 is disassembled and a new detonator 17 is installed. In a typical operation, only the detonator 17 need be replaced, thus reducing turnaround time of the firing head and the perforating gun. The delicate firing head mechanism with the pin 35 remains unharmed and can be reused again and again.

An isolator seal 61 is provided around the head 33 of the arming and contact pin 35, in order to prevent the hot explosive gases from impregnating a pin isolator 63. The pin isolator 63 is located on the opposite side of the head 33 from the detonator 17. The isolator seal 61 also prevents high-pressure borehole and formation fluids from leaking past the o-ring seal and invading the annulus space between the contact pin and the sub. This eliminates the need to rebuild and clean the entire firing head assembly.

With the embodiment shown in FIGS. 5 and 6, the additional upper venting passages 52 improve the venting of the gases to the annulus 69. Staggering the additional upper venting passages 52 closer to the detonator appears to vent the gases more effectively.

The foregoing disclosure and showings made in the drawings are merely illustrative of the principles of this invention and are not to be interpreted in a limiting sense.

What is claimed is:

1. A firing head for a perforating gun for use in downhole applications, comprising:

a) a sub having a first end and a second end;

b) a pin located in the sub, the pin having a head located adjacent to the second end of the sub;

c) a detonating block removably coupled to the second end of the sub, the detonating block having a first chamber that receives the head of the pin and a detonating chamber that is structured and arranged to be adjacent to a detonating material in the perforating gun, the detonating block having a retained;

d) a detonator located in the retainer and extending into the detonating chamber, the detonator having an arming mechanism that is located in the first chamber in selective contact with the head of the pin;

e) at least one venting passage in the detonating block extending from the detonating chamber to an exterior of the detonating block.

2. The firing head of claim 1 further comprising at least one venting passage in the detonating block extending from the first chamber to the exterior of the detonating block.

* * * * *